US007681482B1

(12) United States Patent
Kubinski et al.

(10) Patent No.: US 7,681,482 B1
(45) Date of Patent: Mar. 23, 2010

(54) AUTOMATIC CONNECTOR SYSTEM

(75) Inventors: Ronald A. Kubinski, Mission Viejo, CA (US); Robert J. Atmur, Whittier, CA (US); Thorin Arthur Rogers, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/203,543

(22) Filed: Sep. 3, 2008

(51) Int. Cl.
*F41F 3/055* (2006.01)

(52) U.S. Cl. ..... 89/1.811; 244/171.6; 439/137; 439/197; 439/376

(58) Field of Classification Search ..... 244/171.6, 244/173.3; 89/1.8, 1.811, 1.812; 701/15; 439/246, 248, 249, 135, 136, 137, 139, 140, 439/131, 342, 347, 377, 378, 197, 376
See application file for complete search history.

(56) References Cited

U.S. PATENT DOCUMENTS

| | | | | | |
|---|---|---|---|---|---|
| 2,997,682 | A * | 8/1961 | Grimes et al. | ..... | 439/372 |
| 3,024,703 | A * | 3/1962 | Herold | ..... | 89/1.811 |
| 3,141,715 | A * | 7/1964 | Hereth | ..... | 439/132 |
| 3,183,468 | A * | 5/1965 | Hennessey, Jr. | ..... | 439/157 |
| 3,193,790 | A * | 7/1965 | Boyle et al. | ..... | 439/160 |
| 3,224,335 | A * | 12/1965 | Witherspoon et al. | ..... | 89/1.811 |
| 3,249,013 | A * | 5/1966 | Pride, Jr. et al. | ..... | 89/1.811 |
| 3,735,668 | A * | 5/1973 | Langlois et al. | ..... | 89/1.814 |
| 3,979,086 | A * | 9/1976 | MacAdam | ..... | 244/3.19 |
| 4,031,806 | A * | 6/1977 | Stark et al. | ..... | 89/1.811 |
| 4,184,731 | A * | 1/1980 | Betzmeir | ..... | 439/154 |
| 4,409,880 | A | 10/1983 | Fetterly | | |
| 4,508,404 | A * | 4/1985 | Frawley | ..... | 439/153 |
| 4,522,103 | A * | 6/1985 | Mitzner | ..... | 89/1.811 |
| 5,005,786 | A * | 4/1991 | Okamoto et al. | ..... | 244/172.4 |
| 5,046,691 | A * | 9/1991 | Hart | ..... | 244/172.5 |
| 5,433,132 | A * | 7/1995 | Hufault | ..... | 89/1.812 |
| 5,542,334 | A * | 8/1996 | Wells | ..... | 89/1.812 |
| 6,227,096 | B1 | 5/2001 | Thomas | | |
| 6,615,116 | B2 | 9/2003 | Ebert et al. | | |
| 6,948,953 | B2 * | 9/2005 | Fukamachi | ..... | 439/137 |
| 7,002,336 | B2 | 2/2006 | Leonard et al. | | |
| 7,294,002 | B2 * | 11/2007 | Noro | ..... | 439/342 |
| 7,347,715 | B2 * | 3/2008 | Kobayashi | ..... | 439/376 |
| 7,353,090 | B2 | 4/2008 | Leonard et al. | | |
| 7,575,456 | B2 * | 8/2009 | Cronin | ..... | 439/258 |
| 2007/0228214 | A1 * | 10/2007 | Horak | ..... | 244/63 |
| 2009/0217808 | A1 * | 9/2009 | Rogers et al. | ..... | 89/1.8 |

* cited by examiner

*Primary Examiner*—Michael Carone
*Assistant Examiner*—Benjamin P Lee
(74) *Attorney, Agent, or Firm*—Yee & Associates, P.C.; Charles S. Gumpel

(57) ABSTRACT

An apparatus comprising a housing having an opening, a connector unit, a moveable door, and a biasing system. The connector unit is located inside the housing. The connector unit is capable of providing an electrical connection to a complementary connector unit. The moveable door is capable of being moved into an open position and a closed position, wherein the closed position covers the opening. The biasing system is capable of aligning the connector unit with the complementary connector unit and causing the connector unit to engage the complimentary connector unit.

19 Claims, 11 Drawing Sheets

AUTOMATIC CONNECTOR SYSTEM

BACKGROUND INFORMATION

1. Field

The present disclosure relates generally to connecting objects to each other and, in particular, to a method and apparatus for automatically connecting one object to another object. Still more particularly, the present disclosure relates to a method and apparatus for physically and electrically connecting one object to another object using an automatic connection system.

2. Background

A launch vehicle may be a missile, an aircraft, or other vehicle that obtains thrust by the reaction of a rocket engine. The launch vehicle may sit atop a launch platform at the launch pad which may be capable of withstanding the heat and/or load generated by rocket engines during liftoff. A launch pad may provide a structure that provides service and umbilical structures.

A service structure may provide access to inspect a launch vehicle prior to a launch. Many service structures may be moved and/or rotated to a safe distance. An umbilical structure may be connected to a launch vehicle when the launch vehicle is placed onto a launch pad. The umbilical structure may provide propellant loading, gas, power, and/or communications links to a launching vehicle. One of the umbilical structures may include a cable that may provide communications, links, and/or power to the launch vehicle.

Currently, connecting a launch vehicle to an umbilical cable may involve an operator opening a door to a connector on the launch vehicle and a door to a connector for the launch pad. The operator may perform a visual inspection to ensure that no debris is present and that the connectors are in a condition for engagement.

If the umbilical cable can be connected to the launch vehicle, the launch vehicle may then be placed onto the launch pad in which the placement of the launch vehicle connects the umbilical cable to the launch vehicle. Alternatively, an operator may then manually connect the connectors to each other to connect the umbilical cable to the launch vehicle.

This type of process may be time consuming. Further, the process may include safety concerns with respect to having an operator performing inspections and/or engaging connectors at a launch pad with a launch vehicle.

Therefore, it would be advantageous to have a method and apparatus that overcomes these and possibly other problems.

SUMMARY

In an advantageous embodiment, an apparatus comprises a housing having an opening, a connector unit, a moveable door, and a biasing system. The connector unit is located inside the housing. The connector unit is capable of providing an electrical connection to a complementary connector unit. The moveable door is capable of being moved into an open position and a closed position, wherein the closed position covers the opening. The biasing system is capable of aligning the connector unit with the complementary connector unit and causing the connector unit to engage the complimentary connector unit.

In another advantageous embodiment, an automatic connector system for establishing a connection with a launch vehicle connector comprises a housing having an opening, a connector unit, a moveable door, a biasing system, an engagement element, and an optical sensor system. The connector unit is located inside the housing. A connector unit is capable of providing an electrical connection to a complementary connector unit. The moveable door is capable of being moved into an open position and a closed position, wherein the closed position covers the opening. The biasing system is capable of aligning the connector unit with the complementary connector unit. The biasing system also is capable of moving the connector unit along a first axis substantially normal to the opening and along a second axis along a plane that is substantially parallel to the opening to form a connection with the complementary connector unit. The engagement element is located on an exterior surface of the moveable door. The engagement element is capable of engaging a complementary engagement element for a second moveable door covering the complementary connector unit and wherein movement the moveable door to the open position causes the second moveable door to move to the open position. The optical sensor system is capable of generating video data of the connector unit and the complementary connector unit.

In another advantageous embodiment, a method is present for handling a launch vehicle. A connector unit located in a housing in a launch pad and a complementary connector unit in the launch vehicle is visually inspected with data generated by a video sensor system located within the housing containing the connector unit. A determination is made as to whether to connect the connector unit and the complementary connector unit using the data. The connector unit is aligned with a biasing unit in the housing along a number of axes along a plane substantially parallel to an opening in the housing to align the connector unit with the complementary connector unit in response to a determination to connect the connector unit and the complementary connector unit. The connector unit is moved with the biasing unit along an axis substantially normal to the plane to connect the connector unit to the complementary connector unit.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
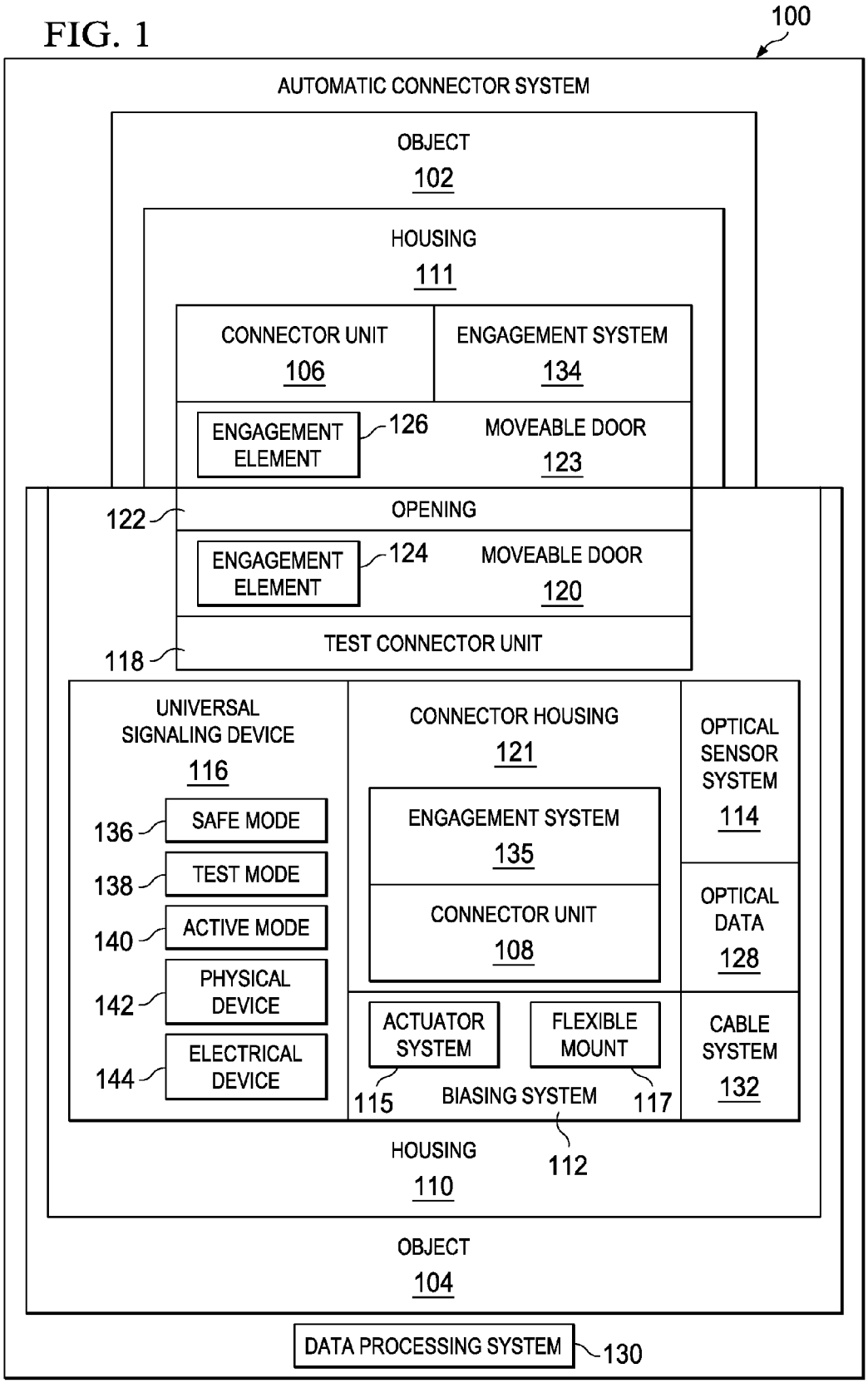
FIG. 1 is a diagram of an automatic connector system in accordance with an advantageous embodiment.

With reference now to the figures and, in particular, with reference to FIG. 1, a diagram of an automatic connector system is depicted in accordance with an advantageous embodiment. In this example, automatic connector system 100 may provide an electrical and/or physical connection between object 102 and object 104. Object 102 may be, for example, a launch vehicle, rocket, or some other suitable object. Object 104 may be, for example, a launch pad, a dock on a space station, or some other suitable object.

In these illustrative examples, a connection between object 102 and object 104 may be provided using connector unit 106 and connector unit 108. Connector unit 106 is a complementary connector unit to connector unit 108. Connector unit 108 may be located within housing 110 in object 104. Complementary connector unit 106 is located in housing 111 in object 102. Housing 110 also may include biasing system 112, optical sensor system 114, universal signaling device 116, test connector unit 118, and moveable door 120.

Connector unit 108 may be moved in a number of different dimensions. For example, biasing system 112 may move connector unit 108 along different axes. The orientation of the axes may be vertical or horizontal, depending on the orientation. The horizontal movement of connector unit 108 may be along one or two axes depending on the particular implementation.

In one advantageous embodiment, connector unit 108 may be located within connector housing 121. Connector unit 108 may be moveable within housing 121. Further, in some advantageous embodiments, connector housing 121 may be connected to moveable door 120. Connector housing 121 may be connected to moveable door 120 by attaching these components to each other. In other advantageous embodiments, this connection may be formed by manufacturing these two functional components as a single physical component.

Biasing system 112 may include actuator system 115 and flexible mount 117. Actuator system 112 may provide for movement of connector unit 108 along a number of different dimensions and/or axes. A number as used herein refers to one or more items. For example, without limitation, actuator system 112 may move connector housing 121 along one axis to move connector unit 108. Actuator system 115 may directly move connector unit 108 along another axis independent of connector housing 121. Flexible mount 117 may provide for further flexibility in connecting connector unit 108 to connector unit 106.

In these examples, biasing system 112 also may move moveable door 120 to expose opening 122 between connector unit 106 and connector unit 108 by moving moveable door 123.

In these examples, moveable door 120 includes engagement element 124, while moveable door 123 includes engagement element 126. Engagement element 124 may be, for example, a pin or rod, while engagement element 126 may be, for example, a hole or slot.

When opening 122 is exposed between connector unit 106 and connector unit 108, optical sensor system 114 may perform an inspection of connector unit 106. Further, optical sensor system 114 may be used to perform an inspection of connector unit 108 prior to movement of moveable door 120. Of course, the inspection may occur after movement of moveable door 120 depending on the particular implementation.

Automatic connector system 100 also may include data processing system 130. Data processing system 130 may control various components within automatic connector system 100. For example, data processing system 130 may control biasing system 112, universal signaling device 116, and optical sensor system 114. Data processing system 130 may communicate with these different components within housing 110 through cable system 132. Cable system 132 contains a number of cables. Cable system 132 may also provide a connection to connector unit 108 for communications with object 102 when connector unit 108 is connected to connector unit 106.

Optical data 128 may be generated by optical sensor system 114 and sent to data processing system 130 for analysis through cable system 132. Data processing system 130 may determine whether connector unit 106 and connector unit 108 should be connected to each other. In these examples, optical sensor system 114 may capture an image of connector unit 106 and an image of connector unit 108 to form optical data 128.

Data processing system 130 may analyze these images in optical data 128 to determine whether connector 106 should be connected to connector 108. This analysis may be made by comparing the images to a database.

If data processing system 130 determines that connector unit 106 should be connected to connector unit 108, data processing system 130 may send a command to biasing system 112 to move connector unit 108 to engage connector unit 106. This engagement may provide both physical and electrical connections. In making these connections, flexible mount 117 may provide additional flexibility in case biasing system 112 does not exactly align connector unit 106 to connector unit 108. In some cases, due to various constraints, biasing unit 112 may not be able to perform an optimal alignment.

Actuator system 115 may have fixed movements to align and connect connector unit 108 to connector unit 106. In other advantageous embodiments, alignment of connector unit 108 to connector unit 106 may be made using optical sensor system 115 to provide guidance in moving connector unit 108.

Engagement system 134 and engagement system 135 may provide further guidance in connecting connector unit 106 to connector unit 108. These engagement systems may include guides, cams, pins, and other elements suitable for providing alignment between connector unit 106 and connector unit 108. Engagement system 134 and engagement system 135 may provide different levels of guidance as connector unit 106 and connector unit 108 move closer to each other for engagement.

Once connector unit 106 is connected and/or engaged to connector unit 108, then data processing system 130 and/or other devices may communicate with object 102 through cable system 132. Connector unit 106 and connector unit 108 may provide a connection to exchange data and/or power.

Further, in the different advantageous embodiments, universal signaling device 116 also may provide a capability to place connector unit 108 in a number of different modes. The universal signaling device may place connector unit 108 into one of safe mode 136, test mode 138, and active mode 140. These different modes may be provided through physical device 142 and electrical device 144. In other words, universal signaling device 116 may generate these modes using both physical and electrical means. Universal signaling device 116 also may include a deadface. In these examples, a deadface may take the form of an electrical mechanical interface. With this feature, universal signaling device 116 may provide isolation of connector unit 108 from connector unit 106 until an appropriate command or signal is received, Universal signaling device 116 does not allow a connection in these illustrative examples unless the proper codes are supplied. These codes may be supplied through data processing system 130 in these examples. When the codes are supplied, both an electrical connection and a physical connection may be made Further, test connector unit 118 may provide a capability to test connector unit 108 prior to connecting connector unit 108 to connector unit 106. In these examples, test connector unit 118 may be attached to moveable door 120. As a result, when moveable door 120 is in a closed position, biasing system 112 may move connector unit 108 to engage test connector unit 118. When a connection is made, data processing system 130 may send various signals through connector unit 108 into test connector unit 118 to verify that connector unit 108 is properly functioning.

FIG. 1 presents functional components and features. The different blocks are not intended to show physical connections or relations, but to provide an illustration of functions and features that may be implemented in physical form. The illustration of automatic connector system 100 in FIG. 1 is not meant to imply physical or architectural limitations to the manner in which different advantageous embodiments may be implemented.

For example, in some advantageous embodiments, data processing system 130 may be located at object 104. In other advantageous embodiments, data processing system 130 may be located remotely and connected to the various components and housing 110 through a network. In another advantageous embodiment, more than one optical sensor system may be present rather than just optical sensor system 114.

In yet other advantageous embodiments, test connector unit 118 may be unnecessary. The different components shown in automatic connector system 100 are presented for purposes of illustrating different features that may be found in different advantageous embodiments. Some embodiments may include features in addition to or in place of some of those illustrated within automatic connector system 100. In yet other advantageous embodiments, some features may be unnecessary.

Figure 2:
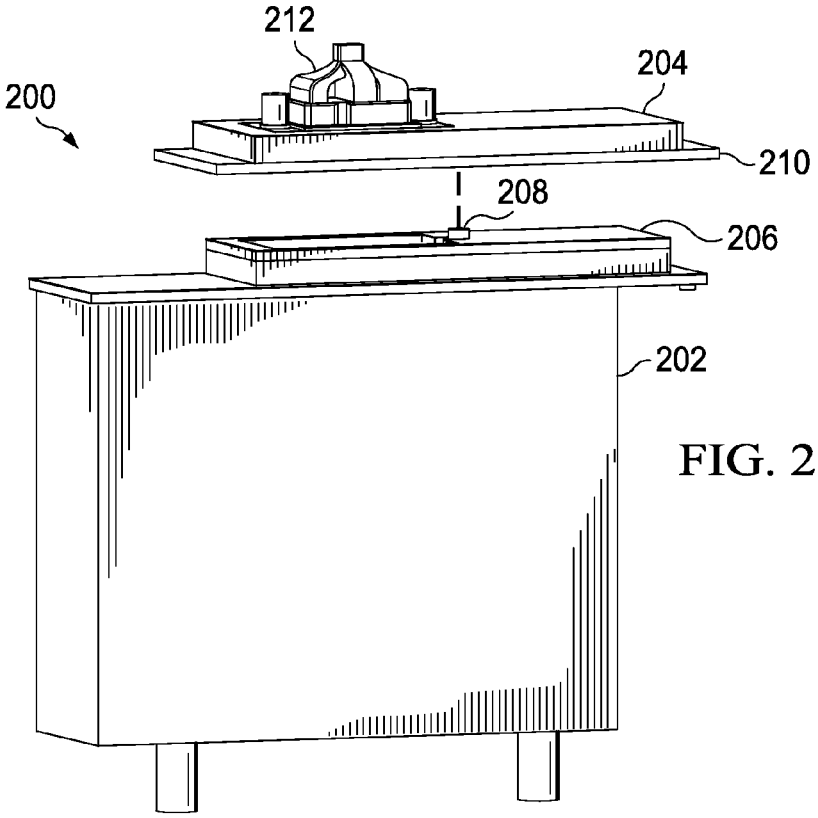
FIG. 2 is a diagram illustrating an automatic connector system in accordance with an advantageous embodiment.

With reference now to FIG. 2, a diagram illustrating an automatic connector system is depicted in accordance with an advantageous embodiment. Automatic connector system 200 is an example of one implementation of automatic connector system 100 in FIG. 1.

In this example, automatic connector system 200 includes housing 202 and housing 204. Housing 202 and housing 204 are examples of implementations of housing 110 and housing 111 in FIG. 1, respectively. In this illustration, moveable door 206 may be seen on housing 202. Additionally, moveable door 206 includes engagement element 208, which is a pin in this example. Housing 204 also includes moveable door 210 and connector unit 212.

Figure 3:
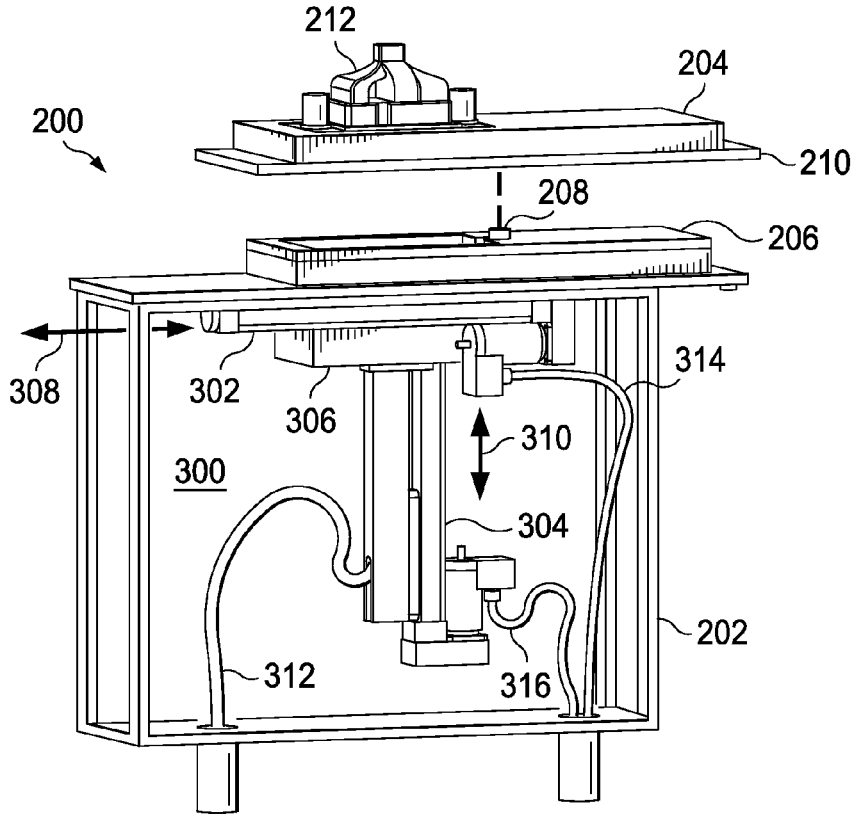
FIG. 3 is another diagram of an automatic connector system in accordance with an advantageous embodiment.

With reference now to FIG. 3, another diagram of an automatic connector system is depicted in accordance with an advantageous embodiment. In this illustration, an exposed view of housing 202 is illustrated to illustrate biasing system 300.

In this illustrative example, horizontal actuator 302 and vertical actuator 304 are examples of components that may be present in an actuator system, such as actuator system 115 in FIG. 1. Horizontal actuator 302 connects to and may move connector housing 306 horizontally along the direction of arrow 308. In this depicted example, moveable door 206 is formed integrally with or attached to connector housing 306. Thus, moving connector housing 306 along the direction of arrow 308 also moves moveable door 206.

As illustrated, vertical actuator 304 is connected to connector housing 306. Vertical actuator 304 may move a connector unit within connector housing 306 vertically along the direction of arrow 310. Although the terms horizontal and vertical are used in these illustrative explanations, these terms are not meant to imply limitations to the orientation in which different advantageous embodiments may be used. For example, housing 202 may be positioned such that vertical actuator 304 leads the connector housing in a horizontal direction or at some other angle.

In this example, cable 312 may be connected to the connector unit within connector housing 306 to provide power and/or communications. Horizontal actuator 302 may be controlled through signals sent along cable 314, while vertical actuator 304 may be controlled by signals sent along cable 316. Cable 312, cable 314, and cable 316 may be part of a cable system such as cable system 132 in FIG. 1.

Figure 4:
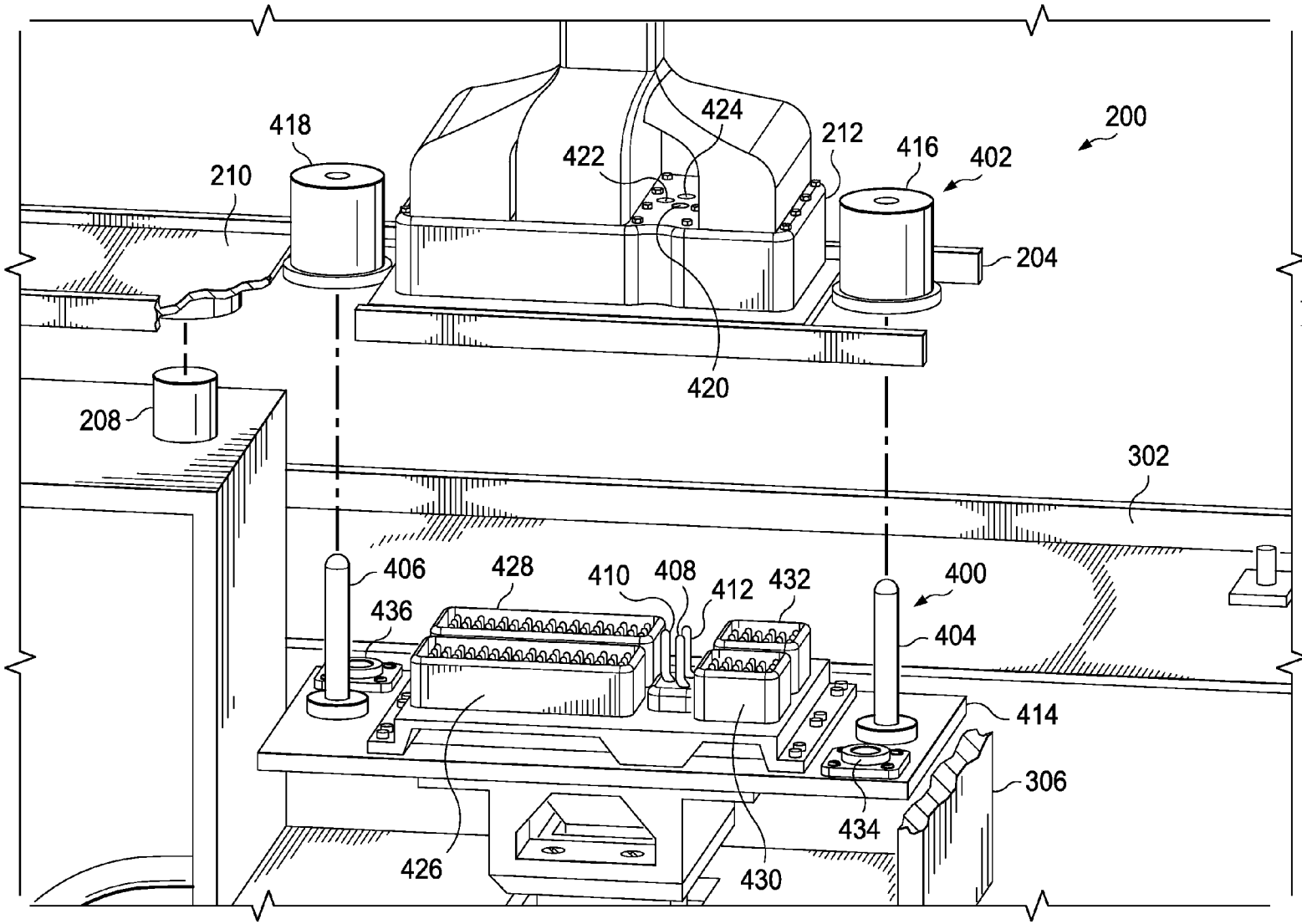
FIG. 4 is another view of a connector system in accordance with an advantageous embodiment.

With reference now to FIG. 4, another view of a connector system is depicted in accordance with an advantageous embodiment. In this example, a partial more detailed view of automatic connector system 200 is depicted in accordance with an advantageous embodiment. In this illustration, a cutaway or exposed view of housing 202, housing 204, and connector housing 306 is depicted.

As can be seen from this view, engagement system 400 and engagement system 402 are illustrated. Engagement system 400 is connected to connector housing 306 and includes pin 404, pin 406, pin 408, pin 410, and pin 412.

In these illustrative examples, pin 404 and pin 406 provide for rough alignment of connector unit 414 to connector unit 212. Pin 408, pin 410, and pin 412 provide for fine alignment of connector unit 414 when engaging connector unit 212. Connector unit 414 is an example of one implementation of connector unit 108 in FIG. 1. Engagement system 400 is an example of one implementation for engagement system 135 in FIG. 1, while engagement system 402 is an example of an implementation for engagement system 134 in FIG. 1.

Engagement system 402 includes hole structures 416, 418, 420, 422, and 424. Hole structure 416 and hole structure 418 provide for rough alignment when connecting connector 212 to connector 414. Hole structure 416 may receive pin 404, while hole structure 418 receives pin 406. Hole structures 420, 422, and 424 may receive pins 408, 410, and 412, respectively during engagement of connector 212 to connector 414.

Electrical connector units 426, 428, 430, and 432 on connector unit 414 may engage complimentary electrical connector units in connector unit 212, which are not seen in this view. These electrical connector units may provide an electrical connection for communications and/or power in these depicted examples.

In this illustrative example, camera 434 and camera 436 are examples of components that may be part of an optical sensor system, such as optical sensor system 114 in FIG. 1. These cameras may provide a capability to obtain optical data for connector unit 212. This view also shows connector housing 306 as being connected to moveable door 210.

In this example, connector housing 306 is integrally formed with moveable door 210. In other words, both connector housing 306 and moveable door 210 may be moved by horizontal actuator 302 at the same time. In other advantageous embodiments, connector housing 306 and moveable door 210 may be separate components that may move independently of each other.

Figure 5:
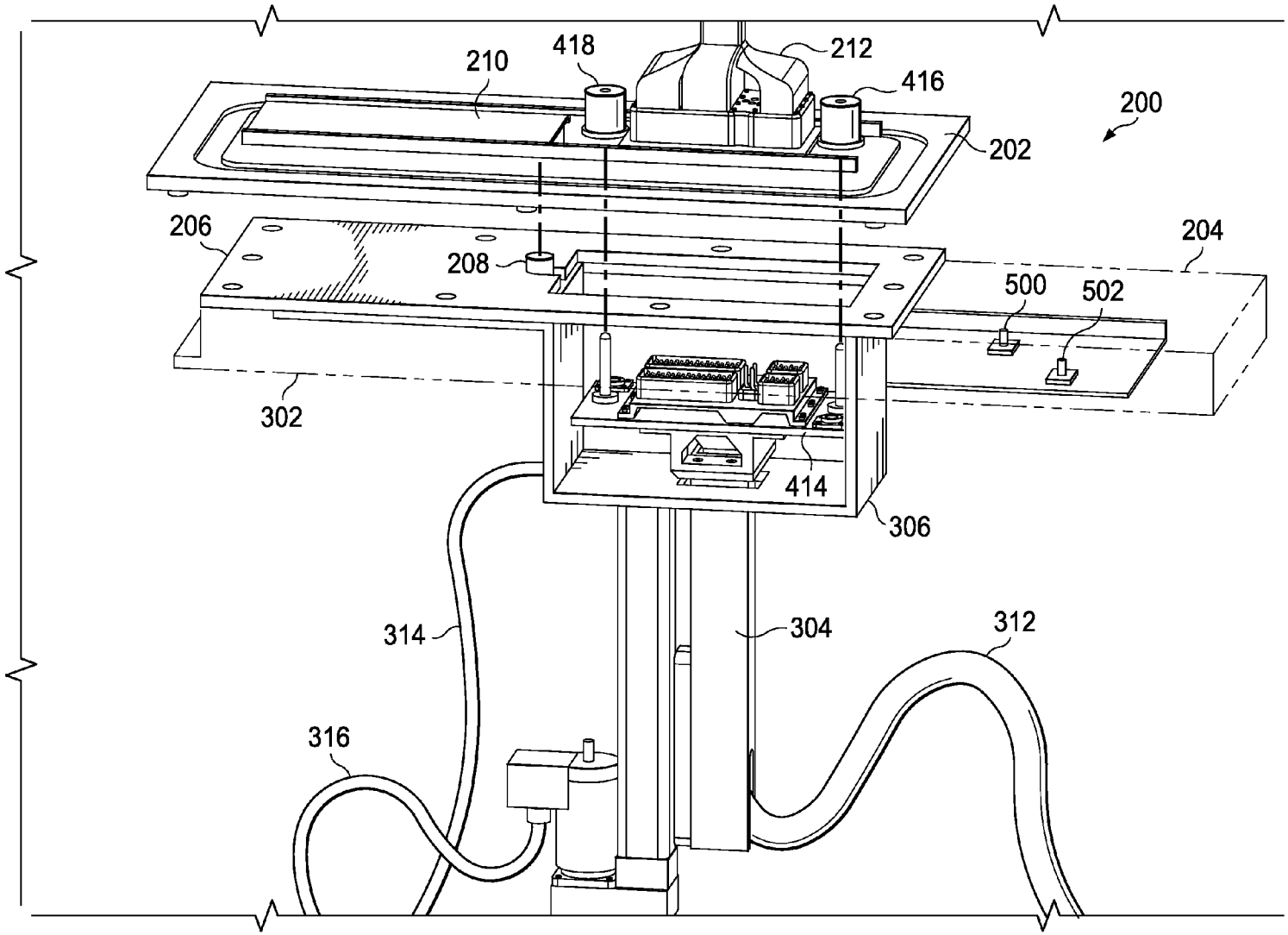
FIG. 5 is another view of an automatic connector system in accordance with an advantageous embodiment.

With reference now to FIG. 5, another view of an automatic connector system is depicted in accordance with an advantageous embodiment. In this example, automatic connector system 200 is shown in another orientation in which camera 500 and camera 502 may be seen. Camera 500 and camera 502 are components that may be part of an optical sensor system, such as optical sensor system 114 in FIG. 1.

These cameras may inspect connector unit 414 when moveable door 206 is in a closed position. Camera 500 and camera 502 point downward and provide optical data about connector unit 414 when moveable door 206 is in a closed position.

Figure 6:
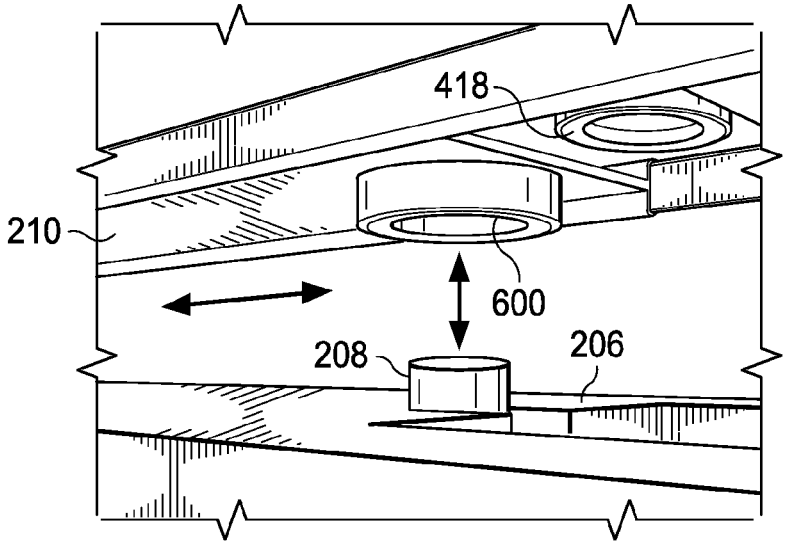
FIG. 6 is a diagram illustrating engagement elements used to move moveable doors in accordance with an advantageous embodiment.

With reference now to FIG. 6, a diagram illustrating engagement elements used to move moveable doors is depicted in accordance with an advantageous embodiment. In this example, engagement element 600 is shown as a hole structure, which may engage engagement element 208, which is shown as a pin in this illustrative example. When engagement element 600 engages engagement element 208, movement of moveable door 206 by horizontal actuator 302 seen in FIG. 3 causes movement of moveable door 210 and connector housing 306 seen in FIG. 3 at the same time.

Figure 7:
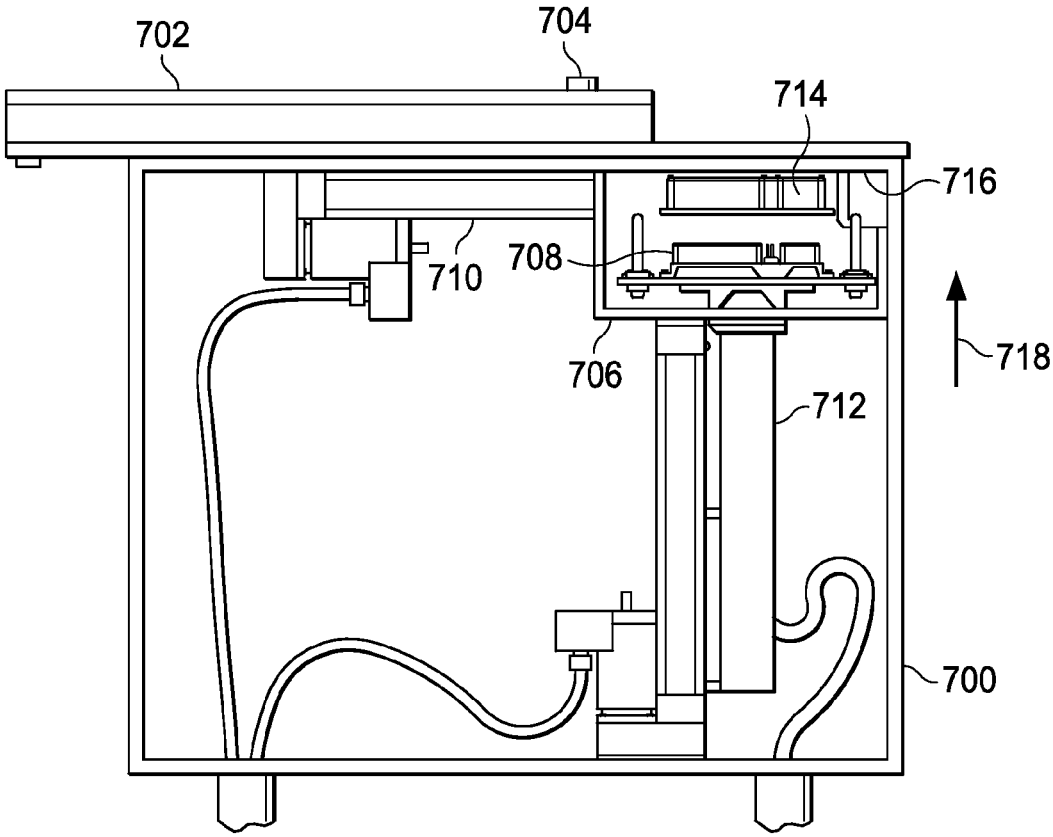
FIG. 7 is a diagram of a housing containing a test connector unit in accordance with an advantageous embodiment.

With reference now to FIG. 7, a diagram of a housing containing a test connector unit is depicted in accordance with an advantageous embodiment. In this example, housing 700 includes moveable door 702, which has engagement element 704. Additionally, housing 700 contains connector housing 706 which houses connector unit 708. Horizontal actuator 710 and vertical actuator 712 also are present within housing 700. These two actuator systems are part of a biasing system, such as biasing system 112 in FIG. 1.

Additionally, test connector unit 714 is shown located within connector housing 706. Test connector unit 714 is attached to topside 716 within housing 700. Test connector unit 714 is in a position to be connected to connector unit 708 for testing when moveable door 702 is in a closed position. When moveable door 702 is in a closed position, vertical actuator 712 may move connector unit 708 vertically in the direction of arrow 718 to engage test connector unit 714. In this manner, connector unit 708 may be tested prior to engagement and/or connection with a connector unit in another object such as a launch vehicle.

The illustration of automatic connector systems in FIGS. 2-7 have been provided for purposes of illustrating a few illustrative examples of how an automatic connector system may be implemented. These illustrations are not meant to imply physical or architectural limitations to how other embodiments may be implemented. For example, in other advantageous embodiments, multiple connector units may be located within a housing, rather than a single connector unit as illustrated in the different examples.

Figure 8:
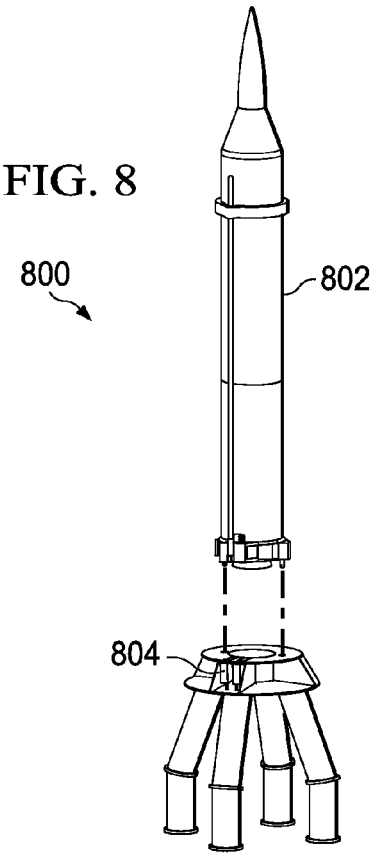
FIG. 8 is a diagram illustrating an implementation of an automatic connector system in accordance with an advantageous embodiment.

With reference now to FIG. 8, a diagram illustrating an implementation of an automatic connector system is depicted in accordance with an advantageous embodiment. In this example, automatic connector system 800 is shown with missile 802 and launch platform 804. Missile 802 is an example of one implementation for object 102 in FIG. 1, while launch platform 804 is an example of an implementation of object 104 in FIG. 1. Automatic connector system 800 may provide electrical and physical connections between missile 802 and launch platform 804.

Figure 9:
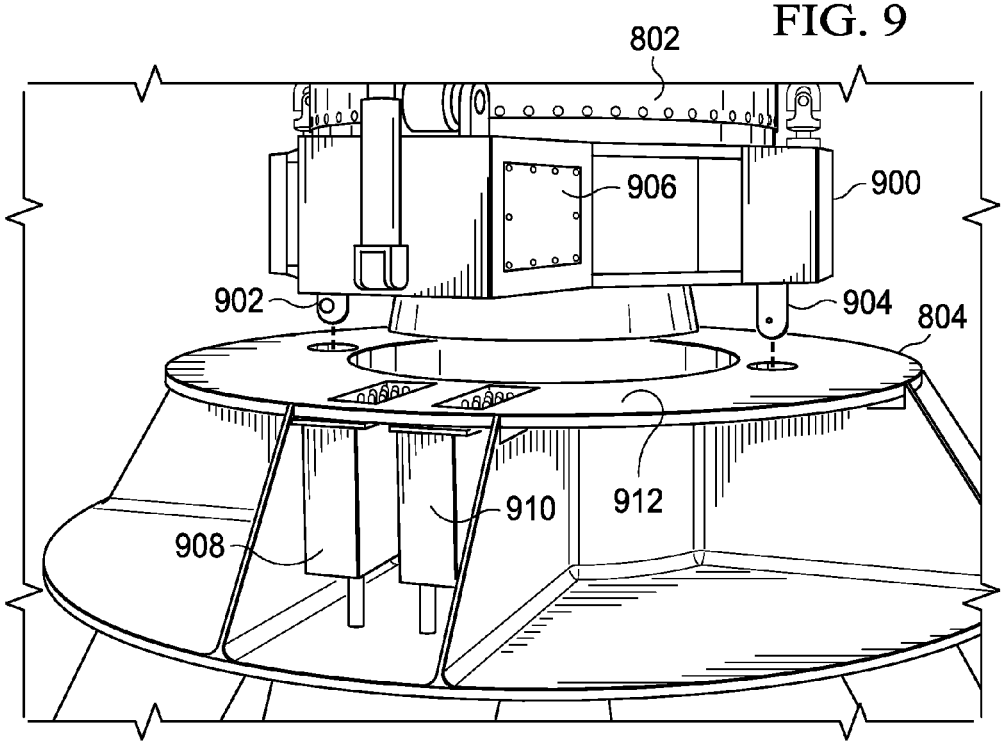
FIG. 9 is a more detailed illustration of a portion of a missile and a launch platform in accordance with an advantageous embodiment.

With reference now to FIG. 9, a more detailed illustration of a portion of a missile and a launch platform is depicted in accordance with an advantageous embodiment. In this figure, a partial view of missile 802 and launch platform 804 is depicted. Trunnion 900 is an example of a lift ring assembly that holds missile 802 and provides a mechanism to connect missile 802 to launch platform 804. When missile 802 launches, trunnion 900 remains in place on launch platform 804.

Trunnion 900 includes mating pin 902 and mating pin 904. In this example, an additional mating pin is present on trunnion 900 but not seen in this view.

Housing 906 is present on trunnion 900 and contains connectors. Housing 906 is an example of housing 111 in FIG. 1. Housing 908 and housing 910, under surface 912 of launch platform 804, are examples of housing 110 in FIG. 1.

When missile 802 is engaged and/or placed onto surface 912 of launch platform 804, the connectors within housings 906, 908, and 910 may be engaged to each other to provide communications and power to missile 802. In these depicted examples, connectors within housing 908 and housing 910 also may be collectively referred to as a plug while connectors within housing 906 may be collectively referred to as a receptacle.

Figure 10:
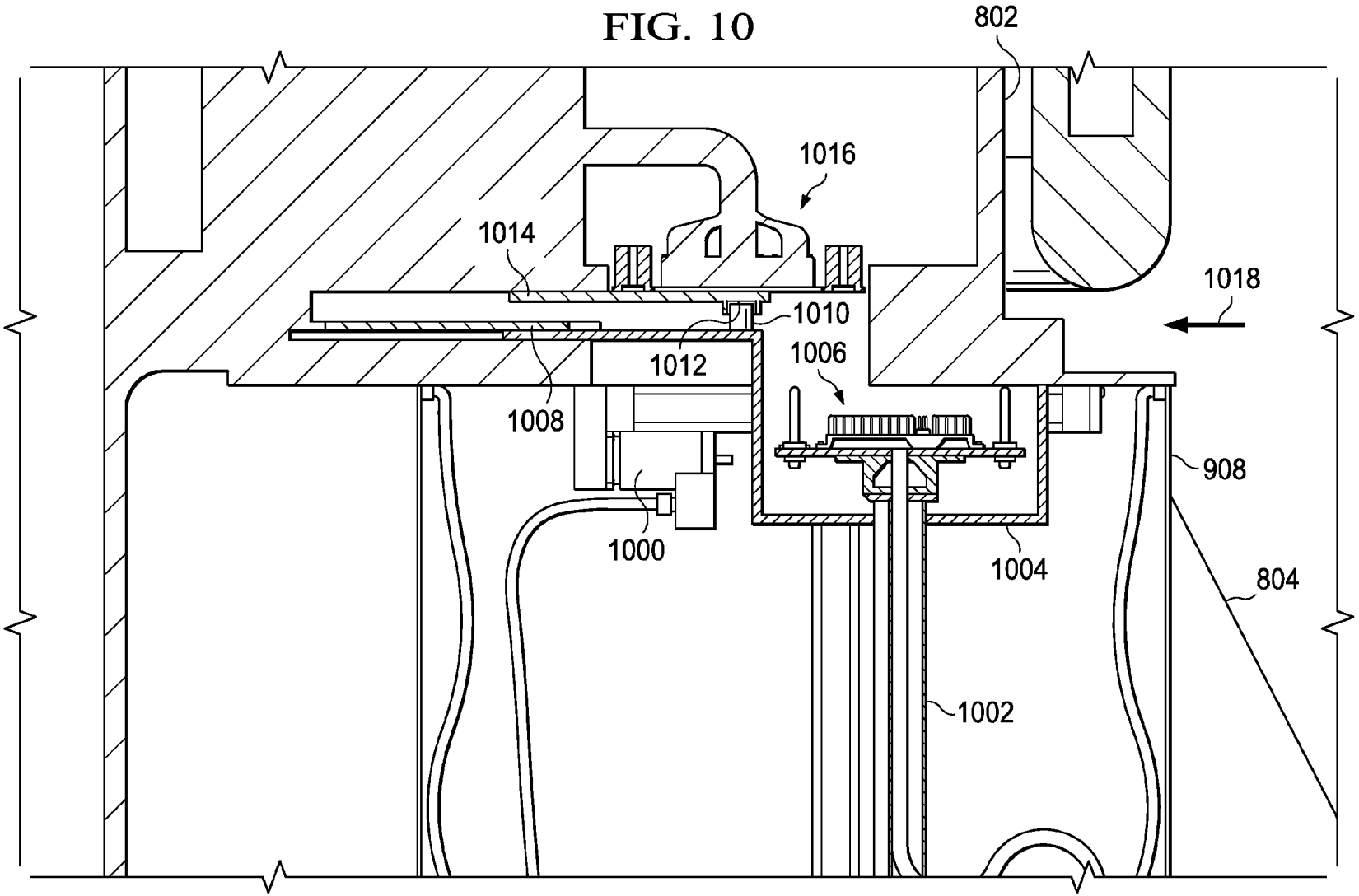
FIG. 10 is a diagram of a partial cross-sectional view of a connector system in accordance with an advantageous embodiment.

With reference now to FIG. 10, a diagram of a partial cross-sectional view of connector system 800 is depicted in accordance with an advantageous embodiment. In this example, missile 802 has been placed onto launch platform 804 and locked into place. A cross-sectional view of housing 908 is shown in this example. In this view, horizontal actuator 1000 and vertical actuator 1002 can be seen within housing 908.

Additionally, connector housing 1004 can be seen with connector unit 1006 inside of connector housing 1004. Also shown in this view is moveable door 1008 with engagement element 1010. Engagement element 1010 is engaged with engagement element 1012 in moveable door 1014. In this example, engagement element 1010 is a pin, while engagement element 1012 is a hole or channel within moveable door 1014. Moveable door 1014 covers connector unit 1016 in missile 802.

In this example, horizontal actuator 1000 moves moveable door 1008 in the direction of arrow 1018 to move connector housing 1004 with connector unit 1006 under connector unit 1016. As can be seen, horizontal actuator 1000 moves both moveable door 1008 and connector housing 1004 with connector unit 1006 at the same time. Moveable door 1008 is connected to or an extension of connector housing 1004 in these examples. Movement of moveable door 1008 and connector housing 1004 in the direction of arrow 1018 may align connector unit 1006 with connector unit 1016.

Figure 11:
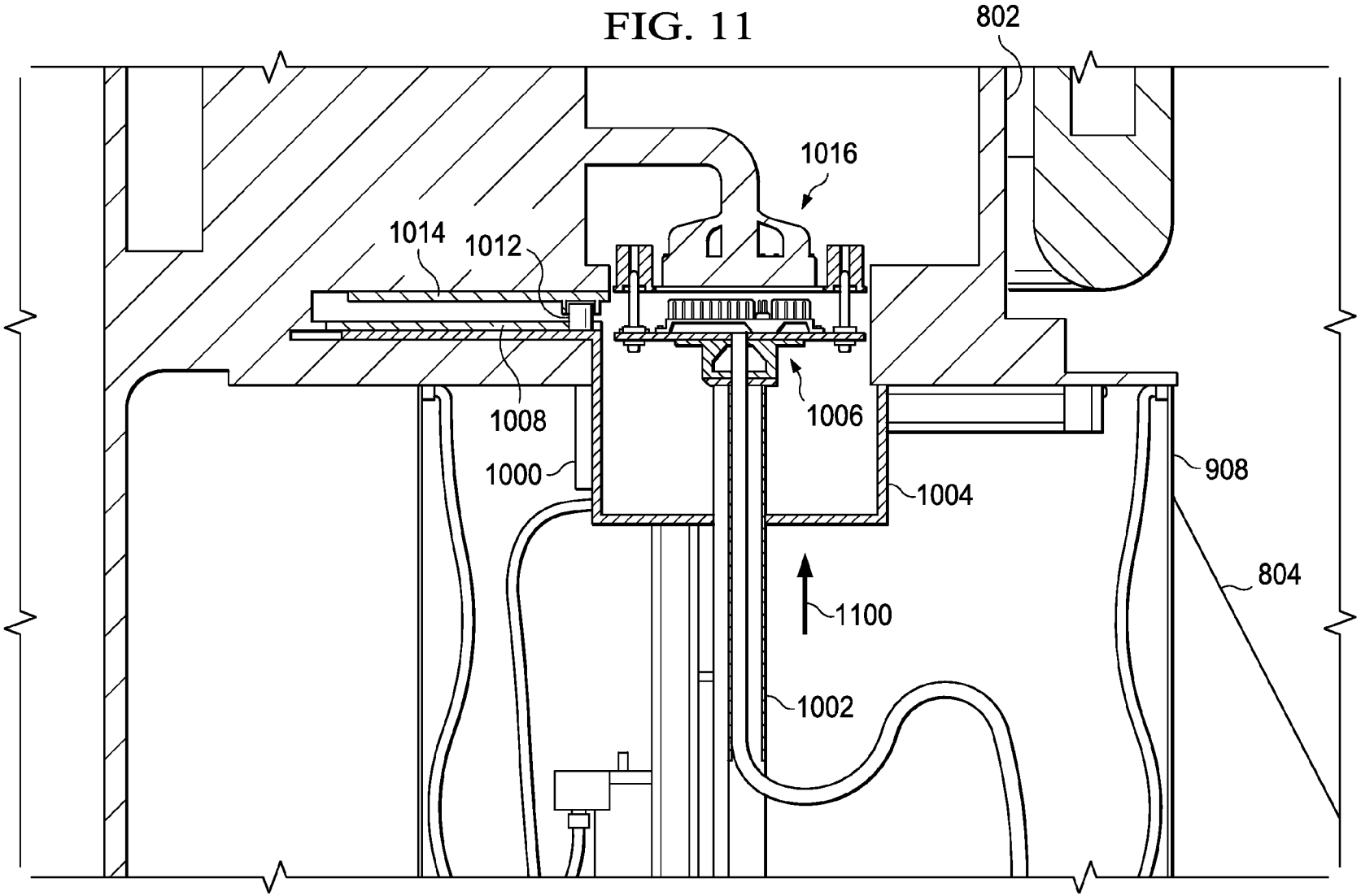
FIG. 11 is a diagram illustrating mating of connector units in an automatic connector system in accordance with an advantageous embodiment.

With reference now to FIG. 11, a diagram illustrating mating of connector units in an automatic connector system is depicted in accordance with an advantageous embodiment. In this example, vertical actuator 1002 moves connector unit 1006 within connector housing 1004 vertically in the direction of arrow 1100. Movement of connector unit 1006 results in connector unit 1006 engaging connector unit 1016.

Figure 12:
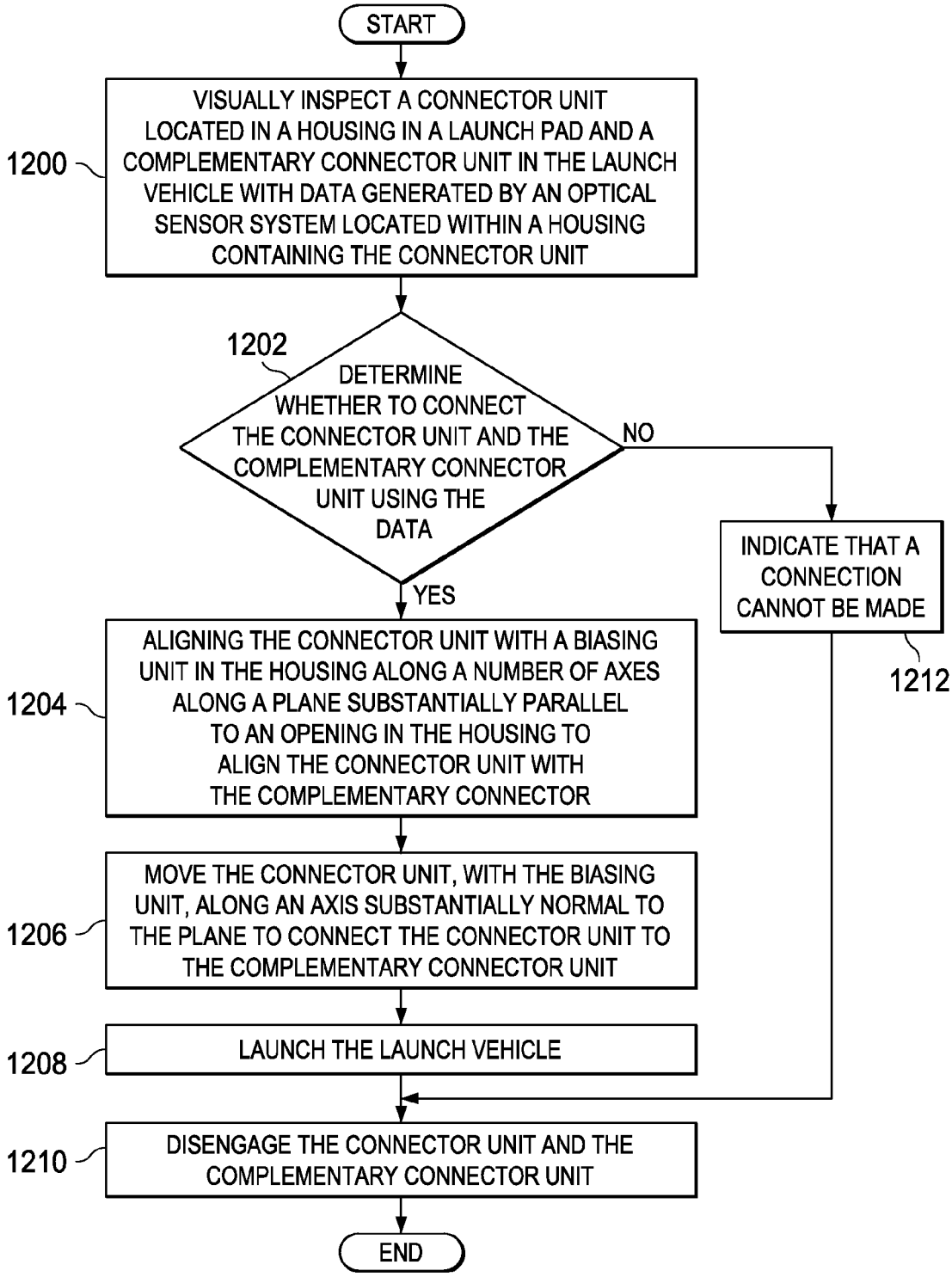
FIG. 12 is a high level flowchart of a process for connecting one object to another object in accordance with an advantageous embodiment.

With reference now to FIG. 12, a high level flowchart of a process for connecting one object to another object is depicted in accordance with an advantageous embodiment. In this example, the process illustrated in FIG. 12 may be employed to connect a launch vehicle to a launch pad. In these examples, the launch vehicle may be, for example, missile 802 in FIG. 8. Of course, other types of launch vehicles and objects may be handled using this process depending on the particular implementation.

The process begins by visually inspecting a connector unit in a housing in the launch pad and a complementary connector unit in the launch vehicle with data generated by an optical sensor system located within the housing containing the connector unit (operation 1200). Operation 1200 may be performed using an optical sensor system such as optical sensor system 114 in FIG. 1 to generate optical data. This optical data may be, for example, images of the connectors. These images may be analyzed by a data processing system such as data processing system 130 in FIG. 1 to determine whether it is safe to connect the connector units to each other. The inspection is made to ensure that no damage is present in the connectors. Further, the inspection also may be made to ensure that no debris may be on or covering the connectors.

Next, determination is made as to whether to connect the connector unit and the complementary connector unit using data generated by the optical sensor system (operation 1202). If the connector unit and the complementary connector unit should be connected, the connector unit is aligned using a biasing unit within the housing along a number of axes along a plane substantially parallel to an opening in the housing to align the connector unit with the complementary connector unit (operation 1204).

The process then moves the connector unit with the biasing unit along an axis that is substantially normal to the plane to connect the connector unit to the complementary connector unit (operation 1206).

The process then launches the launch vehicle (operation 1208). The launching of the launch vehicle may be accomplished through communications established by engaging the connector units to each other. The process then disengages the connector unit from the complementary connector unit (operation 1210), with the process terminating thereafter.

With reference again to operation 1202, if the connector unit should not be connected with the complementary connector unit, the process then indicates the connection cannot be made (operation 1212), with the process terminating thereafter.

Figure 13:
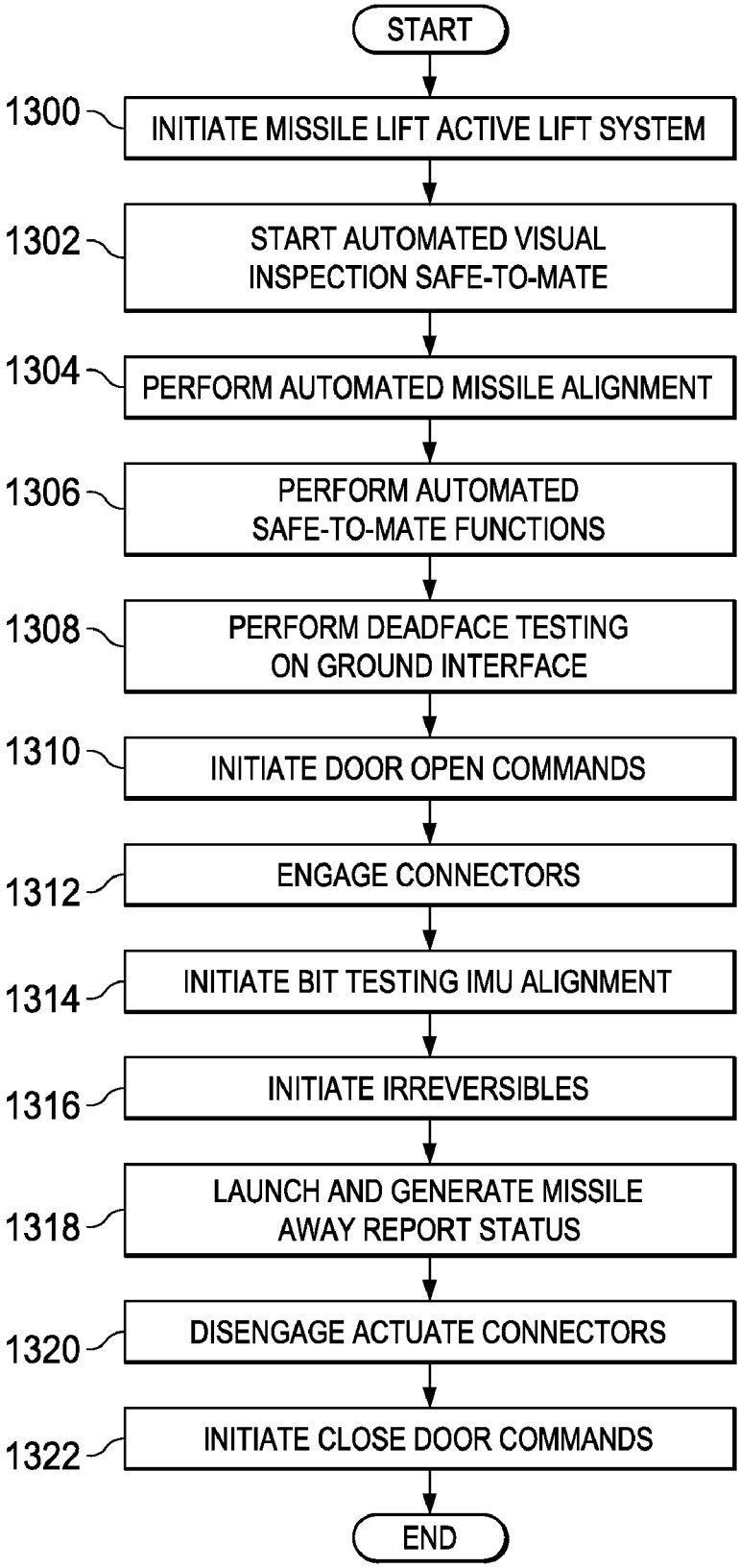
FIG. 13 is a more detailed flowchart of a process for launching a vehicle in accordance with an advantageous embodiment.

With reference now to FIG. 13, a more detailed flowchart of a process for launching a vehicle is depicted in accordance with an advantageous embodiment. The process illustrated in FIG. 13 may be implemented using missile 802 and launch pad 804.

The process begins by initiating a missile lift active lift system (operation 1300). In this operation, the system is commanded to move both the lifting system and the missile into position for lifting. The process then performs an automated visual inspection of a safe to mate process (operation 1302). In this operation, a visual inspection and dead face safe-to-mate occurs. This visual inspection may be performed using optical sensor system 114 in FIG. 1.

The process then performs automated missile alignment (operation 1304). In this operation, a mechanical alignment of the missile to the launch stand is performed using guide pins. The process then performs automated safe to mate functions (operation 1306). In operation 1306, an inspection may be made using optical sensor systems to determine whether the connector units can be connected to each other to provide communications and/or power to the missile.

The process then performs deadface testing on a ground interface (operation 1308). This ground interface may be, for example, test connector unit 714 in FIG. 7. This process allows for testing of components on the launch pad side without actually establishing any physical and/or electrical connection to the missile. More specifically, the connector unit may be tested to ensure that proper communications can be established with the missile.

The process then initiates door open commands (operation 1310). This operation is used to initiate opening of the moveable doors for the connector unit on the launch pad and the connector unit in the missile. The commands may be sent to a horizontal actuator such as horizontal actuator 302 in FIG. 3. The process then engages the connectors to each other (operation 1312). This operation aligns the connector unit in the launch pad with the connector unit in the missile. After alignment occurs, the connector unit in the launch pad is then moved vertically to engage and connect with the connector unit in the missile.

The process then initiates bit testing IMU alignment (operation 1314). In this operation, built-in-test (BIT) processes are performed for electrical testing and verification that the missile and payload elements are functioning as expected. Inertial measurement unit (IMU) testing may also be performed with the guidance system. This testing may include calibrating the guidance system prior to launch.

The process then initiates irreversibles (operation 1316). In operation 1316, actions are initiated to launch the missile. This operation involves a series of steps that are executed during countdown. Once in this state, a positive launch is eminent unless commanded otherwise.

The process then generates launch and missile away report status (operation 1318). In this operation, a report is sent to the appropriate personnel, indicating a successful launch or a failure occurred. The process then disengages the connectors (operation 1320).

Next, close doors commands are initiated (operation 1322), with the process terminating thereafter.

Figure 14:
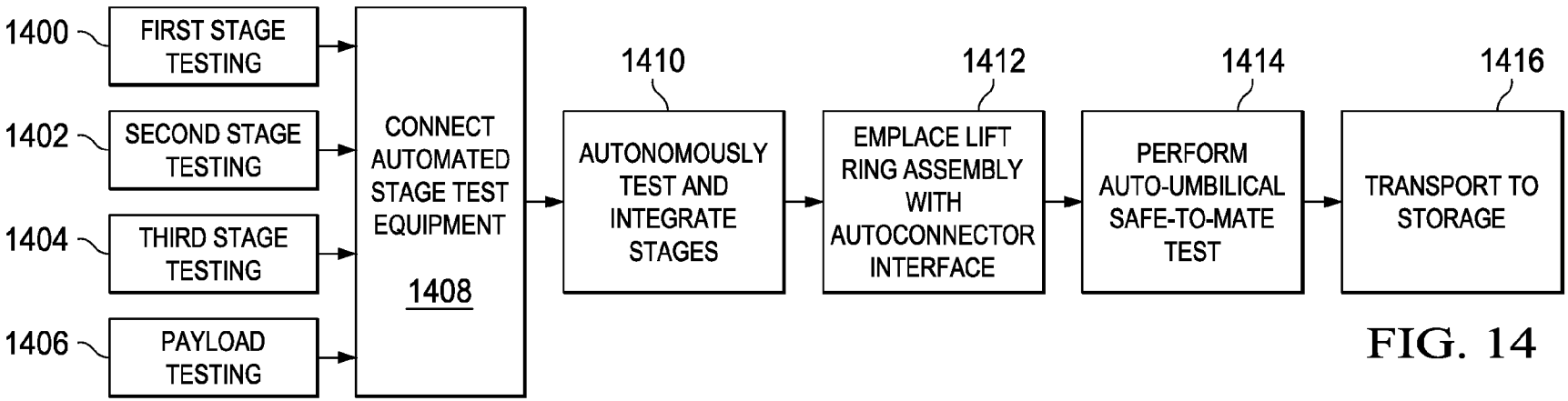
FIG. 14 is a diagram illustrating process flow in missile integration in accordance with an advantageous embodiment.

With reference now to FIG. 14, a diagram illustrating flow in missile integration is depicted in accordance with an advantageous embodiment. The flow illustrated in FIG. 14 may be implemented using one or more components of automatic connector system 100 in FIG. 1.

In this example, first-stage testing 1400, second-stage testing 1402, third-stage testing 1404, and payload testing 1406 may occur. During the testing in these blocks, the validation and verification is performed for the internal components and the external interfaces of the missile stages and the payload. Of course, the number of stages that are tested may vary depending on the type of missile. If the tests are successful, the integration continues. If a failure occurs the process will halt until the failure has been isolated and corrected.

The process then connects automated stage test equipment (operation 1408). After stage integration is complete, the full system end-to-end testing will occur. In operation 1408, the different stages are physically connected to each other. In operation 1408, the stages are tested by individually running lower level isolated tests utilizing the same test equipment. The process then may autonomously test and integrate the stages (operation 1410).

In operation 1410, the automated portion of the testing starts. In this operation, full end-to-end integration testing is performed, in which the integration testing checks all external and internal interfaces in the correct missile configuration. In this operation, built-in-self test procedures and deadface isolation testing are performed. In this operation, the external and internal individual stage and payload interfaces are electrical and/or mechanically connected together, forming the final vehicle configuration.

The process then emplaces the lift-ring assembly with the auto-connector interface (operation 1412). Operation 1412 involves mechanically attaching the lift ring assembly to the configured vehicle. The process then performs a safe to mate test (operation 1414). This operation is performed to determine whether the connector in the missile can be connected to a connector on a launch pad. The process then transports the missile to storage (operation 1416).

Thus, the different advantageous embodiments provide a method and system for connecting objects, such as a missile and a launch pad, to each other. In the different advantageous embodiments, a housing containing a connector unit, moveable door, and a biasing system may be used to align the connector unit to a complementary connector unit and to cause engagement of the connector units to each other. Engagement of the connector unit to the complementary connector unit provides a physical and/or electrical connection through which signals such as those for communications and/or power may be exchanged.

With these and other features described, with respect to different advantageous embodiments, connecting a missile to a launch pad may be made more efficiently and/or more quickly than with currently used processes. Further, the different advantageous embodiments also provide a capability to test and inspect the connectors prior to their use.

The different advantageous embodiments can take the form of an entirely hardware embodiment, an entirely software embodiment, or an embodiment containing both hardware and software elements. Some embodiments are implemented in software, which includes but is not limited to forms, such as, for example, firmware, resident software, and microcode.

Furthermore, the different embodiments can take the form of a computer program product accessible from a computer usable or computer readable medium providing program code for use by or in connection with a computer or any device or system that executes instructions. For the purposes of this disclosure, a computer usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non-limiting examples of a computer readable medium include a semiconductor or solid state memory, magnetic tape, a removable computer diskette, a random access memory (RAM), a read-only memory (ROM), a rigid magnetic disk, and an optical disk. Optical disks may include compact disk—read only memory (CD-ROM), compact disk—read/write (CD-R/W) and DVD.

Further, a computer usable or computer readable medium may contain or store a computer readable or usable program code such that when the computer readable or usable program code is executed on a computer, the execution of this computer readable or usable program code causes the computer to transmit another computer readable or usable program code over a communications link. This communications link may use a medium that is, for example, without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples are modems and network adapters are just a few of the currently available types of communications adapters.

The description of the different advantageous embodiments has been presented for purposes of illustration and description, and is not intended to be exhaustive or limited to the embodiments in the form disclosed. Many modifications and variations will be apparent to those of ordinary skill in the art. Although the different advantageous embodiments have been described with respect to connections made to a missile, other advantageous embodiments may be applied to other types of objects.

For example, without limitation, other advantageous embodiments may be applied to a mobile platform, a stationary platform, a land-based structure, an aquatic-based structure, a space-based structure and/or some other suitable object.

More specifically, the different advantageous embodiments may be applied to, for example, without limitation, a submarine, a train, a spacecraft, space station, a surface ship. For example, a connection may be made between a spacecraft and a space station using the different advantageous embodiments. As another example, a connection may be made between cars in a train using an advantageous embodiment.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a housing having an opening;

a connector unit located inside the housing, wherein the connector unit is capable of providing an electrical connection to a complementary connector unit;

a moveable door capable of being moved into an open position and a closed position, wherein the closed position covers the opening; and a biasing system, wherein the biasing system is capable of aligning the connector unit with the complementary connector unit causing the connector unit to connect to the complementary connector unit, the biasing system further comprising:

a horizontal actuator for moving the connector unit and the moveable door in a horizontal direction in reference to the housing; and a vertical actuator for moving the connector unit in a vertical direction in reference to the housing.

2. The apparatus of claim 1 further comprising:

an optical sensor system located within the housing, wherein the optical sensor system is capable of generating optical data for the connector unit.

3. The apparatus of claim 2, wherein the optical sensor system is capable of generating additional optical data for the complementary connector unit.

4. The apparatus of claim 2, wherein the optical sensor system comprises a camera system, wherein the camera system is capable of generating video data used to determine whether the connector unit and the complementary connector unit should be connected to each other.

5. The apparatus of claim 1, wherein the biasing system is capable of moving the connector unit along an axis substantially normal to the opening.

6. The apparatus of claim 5, wherein the axis is a first axis and wherein the biasing system is capable of moving the connector unit along a second axis along a plane that is substantially parallel to the opening.

7. The apparatus of claim 6, wherein the biasing system is capable of moving the connector unit along a third axis along the plane that is substantially parallel to the opening.

8. The apparatus of claim 1, wherein the biasing system comprises:

a flexible mount capable of deforming in three dimensions when the connector unit is moved to form a connection with the flexible mount.

9. The apparatus of claim 1, wherein the biasing system is capable of moving the connector unit to form a connection with the complementary connector unit.

10. The apparatus of claim 1 further comprising:

a test connector unit located within the housing, wherein the test connector unit is capable of being connected to the connector unit while the moveable door is in a closed position.

11. The apparatus of claim 1, wherein the moveable door is a first door and further comprising:

an engagement element located on an exterior surface of the first door, wherein the engagement element is configured to engage a complementary engagement element of a second door covering the complementary connector unit and wherein movement of the first door into the open position moves the second door into the open position.

12. The apparatus of claim 11, wherein the engagement element is a pin and wherein the complementary engagement element is a channel in the second door.

13. The apparatus of claim 1 further comprising:

a connector housing located within the housing, wherein the connector unit is located within the connector housing, wherein the horizontal actuator moves the connector housing with the moveable door in a horizontal direction in reference to the housing, and wherein the vertical actuator is connected to the connector housing and moves the connector unit within the connector housing in a vertical direction in reference to the housing.

14. The apparatus of claim 1 further comprising:

a universal signaling device capable of isolating the connector unit from any live signals.

15. The apparatus of claim 14, wherein the universal signaling device has a safe mode, a test mode, and an active mode.

16. The apparatus of claim 1, wherein the connector unit comprises at least one command line connector, at least one power line connector, and at least one squib actuation line connector.

17. The apparatus of claim 1 further comprising:

a launch pad, wherein the housing is located in the launch pad.

18. The apparatus of claim 17 further comprising:

a launch vehicle connected to a lift ring assembly, wherein the complementary connector unit is located in the lift ring assembly.

19. An automatic connector system for establishing a connection with a launch vehicle connector comprising:

a housing having an opening;

a connector unit located inside the housing, wherein the connector unit is capable of providing an electrical connection to a launch vehicle connector;

a moveable door capable of being moved into an open position and a closed position, wherein the closed position covers the opening;

a biasing system, wherein the biasing system is capable of aligning the connector unit with the launch vehicle connector and wherein the biasing system is capable of moving the connector unit along a first axis substantially normal to the opening and along a second axis along a plane that is substantially parallel to the opening to form a connection with the launch vehicle connector;

an engagement element located on an exterior surface of the moveable door, wherein the engagement element is configured to engage a complementary engagement element of a second moveable door covering the launch vehicle connector, and wherein movement of the moveable door to the open position causes the second moveable door to move to the open position; and an optical sensor system capable of generating video data of the connector unit and the launch vehicle connector.

* * * * *